US006846214B1

(12) United States Patent
Gotou et al.

(10) Patent No.: US 6,846,214 B1
(45) Date of Patent: Jan. 25, 2005

(54) METHOD OF MANUFACTURING A SPARK PLUG FOR AN INTERNAL COMBUSTION ENGINE

(75) Inventors: Tsunetoshi Gotou, Kariya (JP); Nobuo Abe, Yokkaichi (JP)

(73) Assignee: Denso Corporation (JP)

( * ) Notice: Subject to any disclaimer, the term of this patent is extended or adjusted under 35 U.S.C. 154(b) by 435 days.

(21) Appl. No.: 09/562,952

(22) Filed: May 3, 2000

Related U.S. Application Data

(62) Division of application No. 09/022,122, filed on Feb. 11, 1998, now Pat. No. 6,078,129.

(30) Foreign Application Priority Data

Apr. 16, 1997 (JP) ..... 09-115310

(51) Int. Cl.[7] ..... H01T 13/38
(52) U.S. Cl. ..... 445/7
(58) Field of Search ..... 445/7; 313/141

(56) References Cited

U.S. PATENT DOCUMENTS

| | | | | |
|---|---|---|---|---|
| 4,324,588 A | | 4/1982 | Zysk | |
| 4,581,558 A | | 4/1986 | Takamura | |
| 5,320,569 A | * | 6/1994 | Oshima et al. | 445/7 |
| 5,395,273 A | * | 3/1995 | Matsutani | 445/7 |
| 5,440,198 A | * | 8/1995 | Oshima et al. | 313/141 |
| 5,448,130 A | | 9/1995 | Matsutani | |
| 5,461,210 A | | 10/1995 | Matsutani | |
| 5,497,045 A | | 3/1996 | Matsutani | |
| 5,514,929 A | | 5/1996 | Kawamura | |
| 5,578,895 A | | 11/1996 | Oshima | |
| 5,736,809 A | | 4/1998 | Matsutani | |
| 5,793,793 A | | 8/1998 | Matsutani | |
| 5,869,921 A | | 2/1999 | Matsutani | |
| 5,894,186 A | | 4/1999 | Matsutani | |
| 5,973,443 A | * | 10/1999 | Chang et al. | 313/141 |
| 5,998,913 A | * | 12/1999 | Matsutani | 313/141 |
| 6,094,000 A | * | 7/2000 | Osamura et al. | 313/141 |

FOREIGN PATENT DOCUMENTS

| | | | |
|---|---|---|---|
| EP | 0 635 920 A1 | | 1/1995 |
| GB | 479 540 | | 9/1937 |
| JP | 3 176979 | | 7/1991 |
| JP | 7-37677 | | 2/1995 |
| JP | 9-7733 | * | 1/1997 |
| JP | 10-22052 | | 1/1998 |

* cited by examiner

*Primary Examiner*—Joseph Williams
(74) *Attorney, Agent, or Firm*—Nixon & Vanderhye PC

(57) ABSTRACT

In a spark plug for an internal combustion engine, a noble metal chip such as an iridium alloy chip is bonded on the tip of a center electrode made of a material such as nickel by laser beam welding. The noble metal chip contains another noble metal such as rhodium having a melting point lower than that of the noble metal chip. By laser welding, a molten bond containing the noble metal melted thereinto from the noble metal chip is formed at the junction of the noble metal chip and the center electrode. Alternatively, the noble metal to be melted into the molten bond may be supplied by a separate noble metal plate. The molten bond thus made has a high bonding strength and a small thermal stress, and thereby durability of the spark plug is improved.

18 Claims, 9 Drawing Sheets

METHOD OF MANUFACTURING A SPARK PLUG FOR AN INTERNAL COMBUSTION ENGINE

CROSS-REFERENCE TO RELATED APPLICATION

This is a divisional of application Ser. No. 09/022,122, filed Feb. 11, 1998 now U.S. Pat. No. 6,078,129, the entire content of which is hereby incorporated by reference in this application.

This application is based upon and claims benefit of priority of Japanese Patent Application No. Hei-9-115310 filed on Apr. 16, 1997, the content of which is incorporated herein by reference.

BACKGROUND OF THE INVENTION

1. Field of the Invention

The present invention relates to a spark plug for an internal combustion engine which includes a noble metal chip bonded either on a tip of a center electrode or a ground electrode.

2. Description of Related Art

To improve durability and performance of an spark plug for an internal combustion engine, a spark plug using a platinum (Pt) alloy as either a center or ground electrode has been proposed and is in use. Recently, there has been a tendency to make both center and ground electrodes smaller in diameter and elongated in order to further improve sparking performance and ignitability in consideration of cleaner exhaust and lean combustion. When the Pt alloy electrode is used, for example, in a form of a thin and elongated center electrode, the spark gap tends to be enlarged and spark malfunction often occurs because of dissipation of the electrode.

As a counter measure to this problem, it has been proposed to bond a noble metal chip on either the center or ground electrode. The noble metal chip may be bonded on the electrode by resistance welding. However, when the noble metal chip is bonded on the electrode by resistance welding, the welded portion may be damaged due to thermal stress caused by a difference in thermal expansion coefficients of the noble metal and the electrode.

The noble metal chip may be bonded by laser welding. In laser welding, a laser beam having a high energy density is focused on a junction of the noble metal chip and the electrode. Both of the noble metal and a metallic material of the electrode are melted by the high density laser beam and make a molten bond at the junction. However, a ratio of the noble metal melted into the electrode material in the molten bond is heavily dependent on the energy of the laser beam, and accordingly durability of a spark plug becomes variable depending on the laser beam energy. For example, if the noble metal chip is made of iridium (Ir) and the electrode to which the noble metal chip is bonded is made of nickel (Ni), a ratio of Ir to Ni in the molten bond is very small because the melting point of Ir is much higher than that of Ni (Ir: 2450° C.; Ni: 1450° C.). When the Ir ratio in the molten bond is very small, thermal stress at the junction is not alleviated. If the laser energy is increased to melt Ir in a higher ratio, Ni evaporates and makes voids in the molten bond and a large depression is formed on the periphery of the molten bond, because the melting point of Ir and the boiling point of Ni are not far apart (the boiling point of Ni: 2700° C.).

SUMMARY OF THE INVENTION

The present invention has been made in view of the above-mentioned problems, and an object of the present invention is to provide a durable spark plug for an internal combustion engine having an electrode on which a noble metal chip is firmly bonded, and more particularly to provide a molten bond having a high bonding strength between the electrode and the noble metal chip by laser welding. Thermal stress in the molten bond is greatly decreased at the same time, realizing a high durability.

According to the present invention, a noble metal chip made of a material such as iridium alloy is bonded on the tip of the center electrode made of a material such as nickel by laser beam welding. The iridium chip contains another noble metal such as rhodium which has a lower melting point than iridium. The laser beam is radiated on the junction of the center electrode and the noble metal chip to form a molten bond at the junction. The rhodium contained in the noble metal chip is melted into the molten bond, forming an alloy containing three materials, that is, nickel, rhodium and iridium.

Alternatively, the noble metal such as rhodium to be melted into the molten bond may be provided in a form of a separate metal plate which is placed between the center electrode and the noble metal chip when the laser beam is radiated.

In order to obtain the molten bond having a sufficiently high bonding strength and a sufficiently small thermal stress, the noble metal such as rhodium melted into the molten bond has to be a material having a melting point of 1,500 to 2,100° C. and a linear expansion coefficient of 8 to $11\times10^{-6}$/° C. Also, more than 1 wt % of the noble metal has to be melted into the molten bond, and preferably the thickness of the molten bond containing more than 1 wt % of the noble metal is more than 0.2 mm. Further, the noble metal chip alloy such as a iridium alloy has to be a material having a melting point higher than 2,200° C. to alleviate dissipation of the electrode in operation.

The noble metal chip may be bonded on the ground electrode instead of the center electrode or on both of them.

Other objects and features of the present invention will become more readily apparent from a better understanding of the preferred embodiments described below with reference to the following drawings.

DETAILED DESCRIPTION OF THE PREFERRED EMBODIMENTS

Figure 1A:
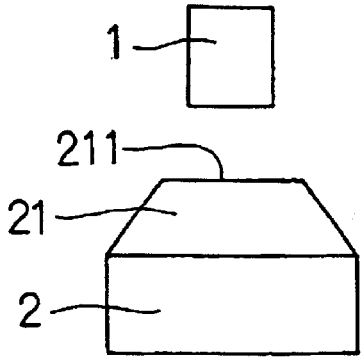
FIGS. 1A to 1C show a process of making a molten bond between a noble metal chip and a center electrode by laser welding.
Figure 1B:
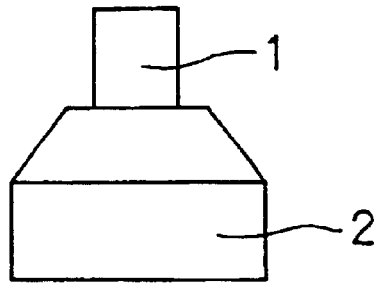
Figure 1C:
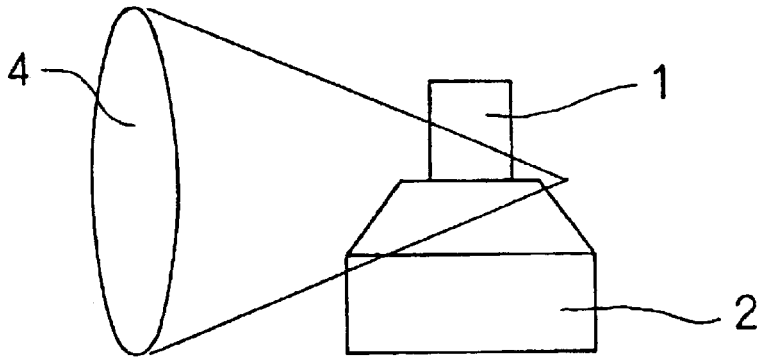
Figure 1D:
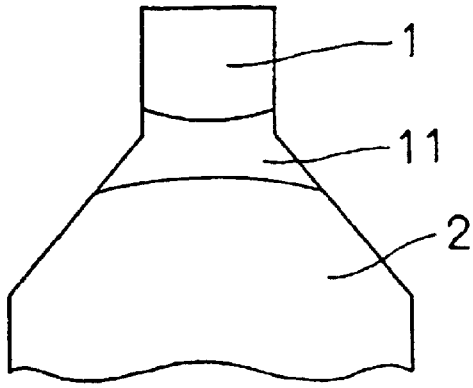
FIG. 1D is a fragmentary view showing a bonded center electrode as a first embodiment according to the present invention.
Figure 2:
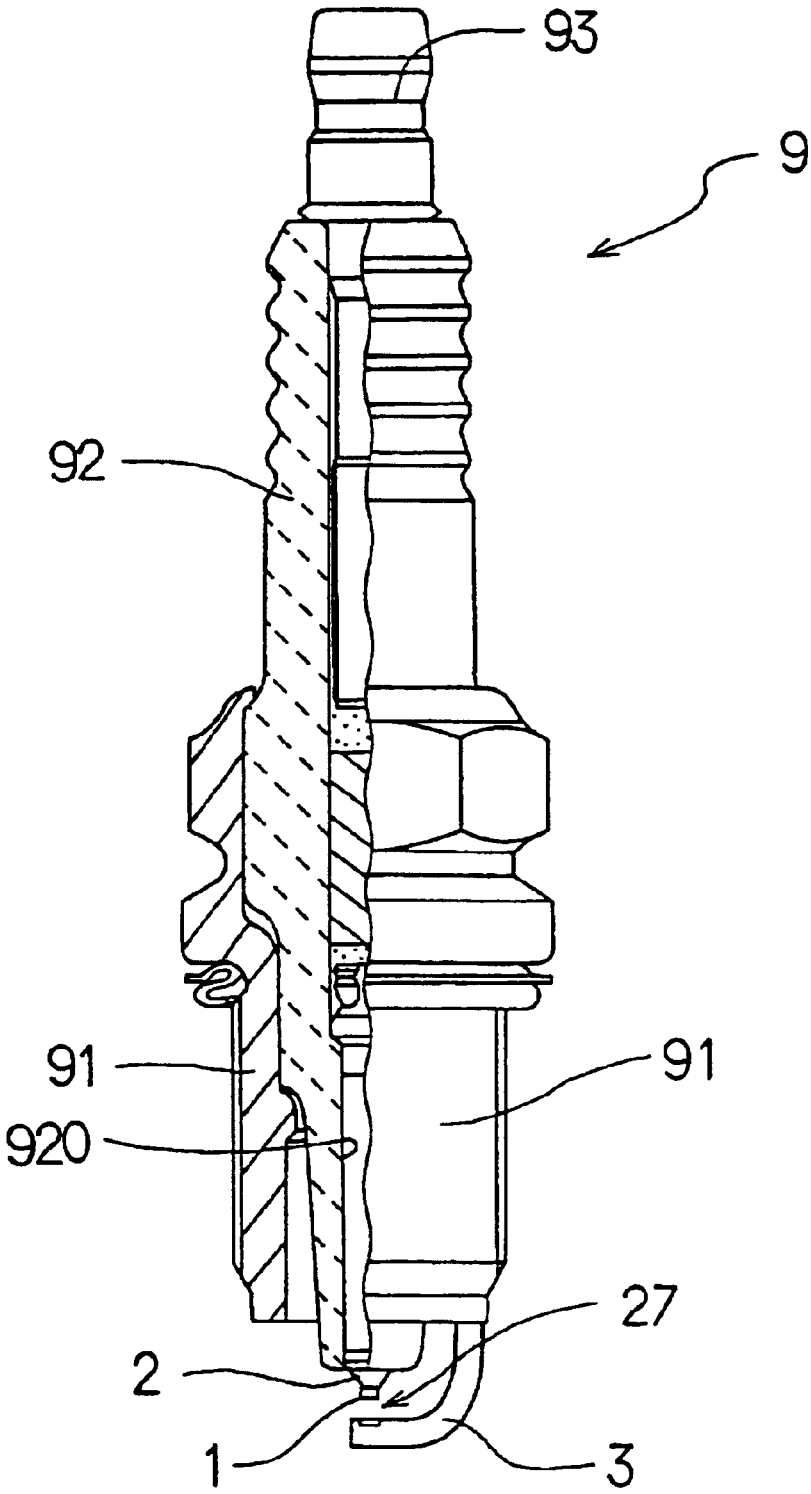
FIG. 2 is a half-cross-sectional view showing a spark plug for an internal combustion engine to which the present invention is applied.
Figure 3:
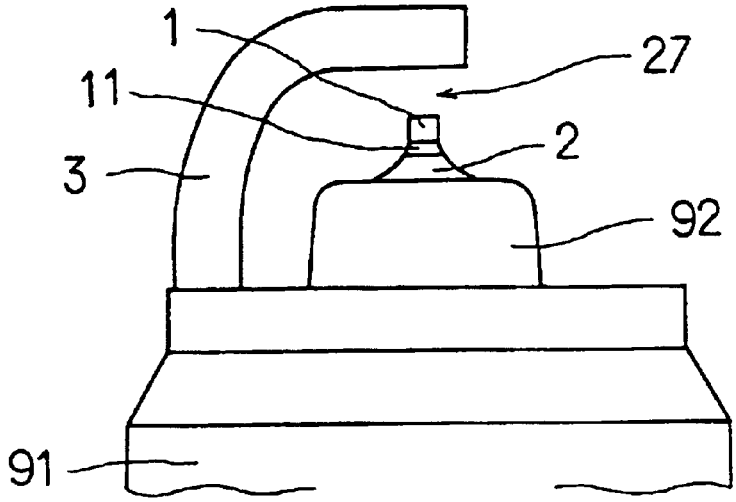
FIG. 3 is a fragmentary view showing the bonded center electrode of the spark plug.

Referring to FIGS. 1 to 8, a first embodiment according to the present invention will be described. FIG. 2 shows spark plug 9 for an internal combustion engine to which the present invention is applied, and FIG. 3 shows a part of the spark plug including center electrode 2 to which noble metal chip 1 is welded. Referring to FIG. 2, spark plug 9 is composed of insulator 92 having through hole 920 therein, center electrode 2 disposed at the bottom end of through hole 920, metal housing 91 which holds insulator 92 therein, ground electrode 3 attached to metal housing 91 and disposed to face center electrode 2, and terminal 93 for connecting the spark plug to a high voltage source. Center electrode 2 and ground electrode 3 constitute spark gap 27. On the tip of center electrode 2, noble metal chip 1 is bonded by laser welding.

Referring to FIG. 1D, noble metal chip 1 made of an Ir (iridium) alloy having a melting point higher than 2,200° C. is welded to center electrode 2 with molten bond 11 interposed therebetween. A noble metal having a melting point of 1,500 to 2,100° C. and a linear expansion coefficient of 8 to $11\times10^{-6}$/° C. is contained in molten bond 11 at a ratio higher than 1 weight percent (wt %). Though the noble metal chip is bonded to the center electrode in this embodiment, it may be bonded to the ground electrode in the same manner as described hereunder.

Referring to FIGS. 1A to 1C, a process of welding noble metal chip 1 to center electrode 2 will be described. In this embodiment, noble metal chip 1 is made of Ir alloy containing rhodium (Rh), the amount of which is varied as explained later. As shown in FIGS. 1A and 1B, noble metal chip 1 is placed on end surface 211 of tip 21 of the center electrode and preliminarily connected to the end surface by resistance welding. Then, laser beam 4 is radiated and focused on a junction between noble metal chip 1 and center electrode 2 as shown in FIG. 1C. Under radiation of laser beam 4, center electrode 2 is rotated so that a whole periphery of the junction is subjected to the laser beam. The junction of noble metal chip 1 and center electrode 2 is melted by the laser beam, forming metal bond 11, and noble metal chip 1 is welded to center electrode 2.

In this particular embodiment, noble metal chip 1 is made of an Ir—Rh alloy (content of Rh is varied), and the diameter of the chip is 0.7 mm and its thickness is 1.0 mm. As the laser a YAG laser is used. Center electrode 2 is made of a nickel (Ni) alloy containing 15.5 wt % chrome (Cr) and 8.0 wt % iron (Fe). The YAG laser energy is varied in three steps, 5.0 joule (J), 7.5 J and 10.0 J.

Figure 4:
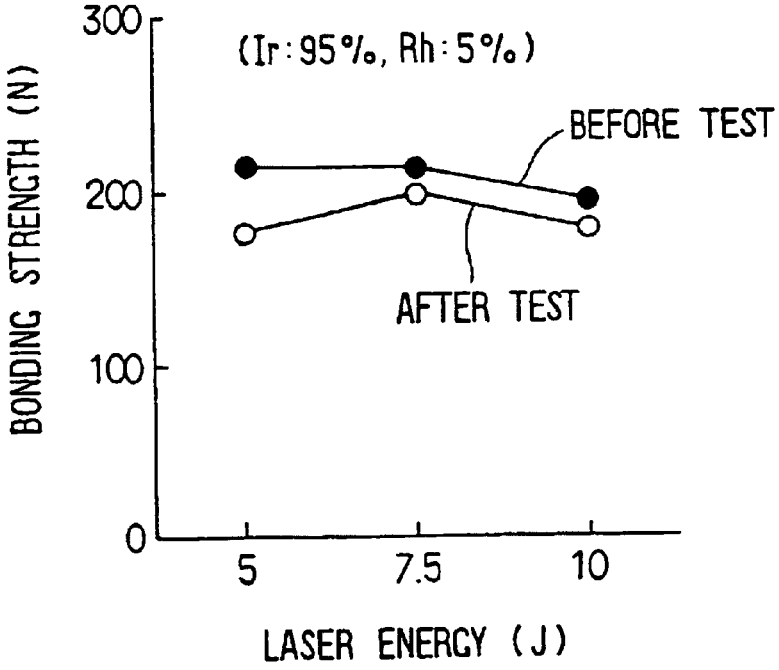
FIG. 4 is a graph showing the relation between laser energy and bonding strength before and after durability tests.

Spark plugs 9 made as described above were subjected to durability tests. The spark plugs were installed on a 6-cylinder 2000 cc internal combustion engine, and the engine was driven for 100 hours by repeating a cycle consisting of 1 minute idling and 1 minute full throttle operation at 6000 rpm. The durability test results are shown in FIG. 4, in which the laser energy used for making molten bond 11 between noble metal chip 1 and center electrode 2 is shown on the abscissa, and bonding strength of the molten bond in newton (N) is shown on the ordinate. The bonding strength (N) represents a bending strength of molten bond 11. The higher the bonding strength is, the higher bondability is secured and the smaller the thermal stress in molten bond 11 becomes, resulting in a longer life of the spark plug. Noble metal chip 1 of the spark plugs used in the durability tests is made of an Ir alloy containing 5 wt % Rh. As seen from the graph in FIG. 4, a stable bonding strength is secured, not depending on the level of the laser energy.

Figure 5:
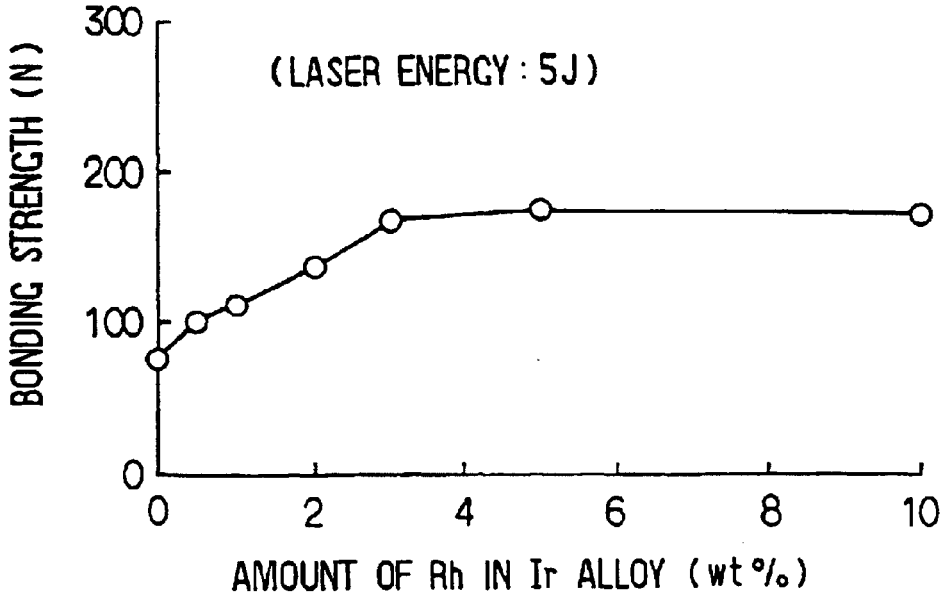
FIG. 5 is a graph showing the relation between the amount of Rh contained in an Ir alloy and the strength of a molten bond formed by laser energy of 5 joule.

FIG. 5 shows the results of another durability test which was performed for spark plugs having noble metal chip 1 made of an Ir alloy containing various amounts of Rh. The laser energy used in forming molten bond 11 is fixed at 5 joule (J). Conditions of this durability test are the same as those mentioned above. In FIG. 5, the bonding strength is shown on the ordinate, and the amount of Rh contained in noble metal chip 1 on the abscissa. As seen in the graph, the bonding strength increases in proportion to the amount of Rh up to 3 wt %, and then becomes stable. It is seen that bonding strength well over 100 N is secured when more than 2 wt % Rh is contained in noble metal chip 1. When 2 wt % of Rh is contained in noble metal chip 1, thickness T of molten bond 11 where more than 1 wt % of Rh is contained is about 0.2 mm.

Figure 6:
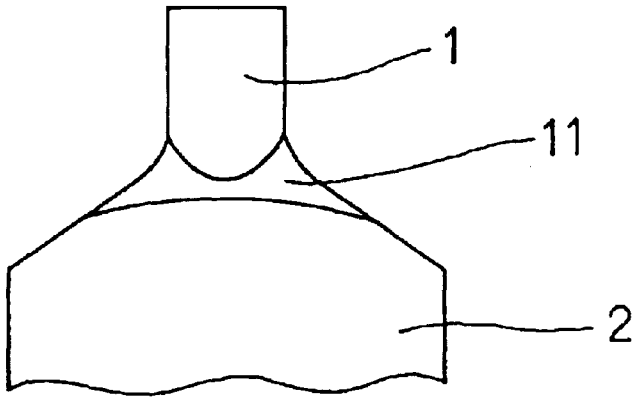
FIG. 6 is a fragmentary view showing a center electrode bonded with laser energy of 5 joule.
Figure 7:
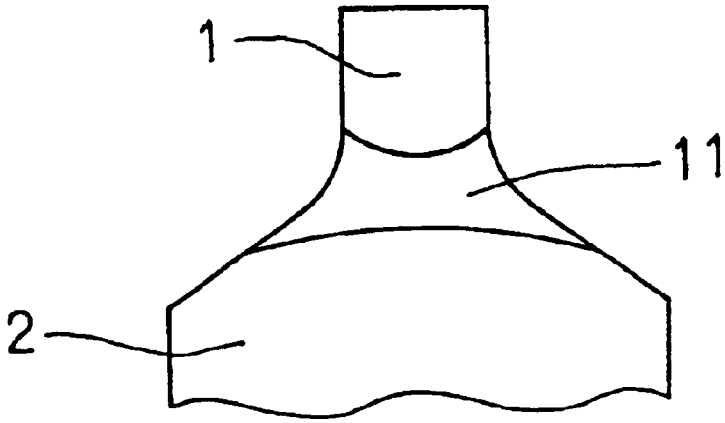
FIG. 7 is a fragmentary view showing a center electrode bonded with laser energy of 7.5 joule.
Figure 8:
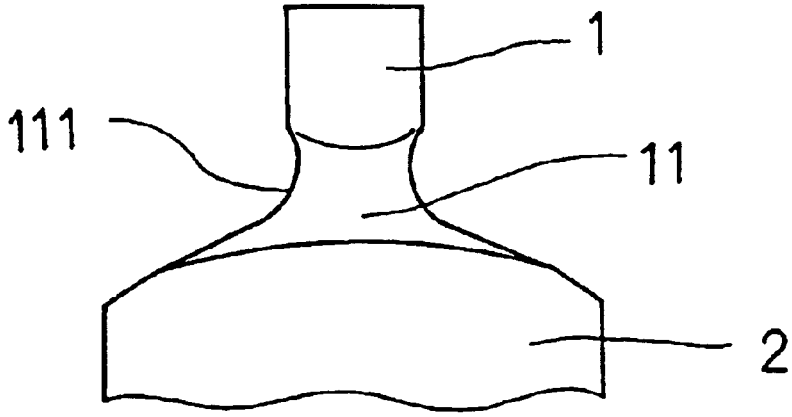
FIG. 8 is a fragmentary view showing a center electrode bonded with laser energy of 10 joule.

The shape of each molten bond 11 which is formed with the laser beam having energy of 5.0 J, 7.5 J and 10.0 J, respectively, is observed and shown in FIGS. 6, 7 and 8. The molten bond formed with 5.0 J laser energy shown in FIG. 6 is relatively small, but Rh contained in the molten bond is higher than that of a comparative sample mentioned later (in which noble metal chip is made of pure Ir containing no Rh). The molten bond formed with 7.5 J laser energy shown in FIG. 7 is large, and Rh and Ni are well melted into the molten bond. The molten bond formed with 10.0 laser energy shown in FIG. 8 is sufficiently large, and no void is observed in the molten bond though depression 111 is formed around the periphery of the molten bond.

Figure 9A:
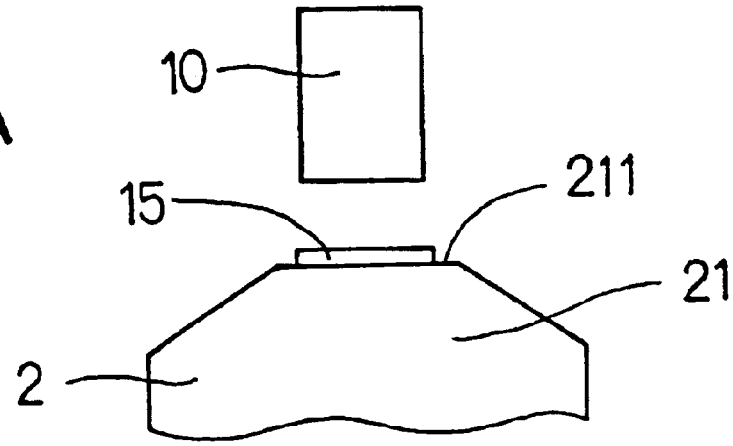
FIGS. 9A and 9B show another process of making a molten bond between a noble metal chip and a center electrode by laser welding.
Figure 9B:
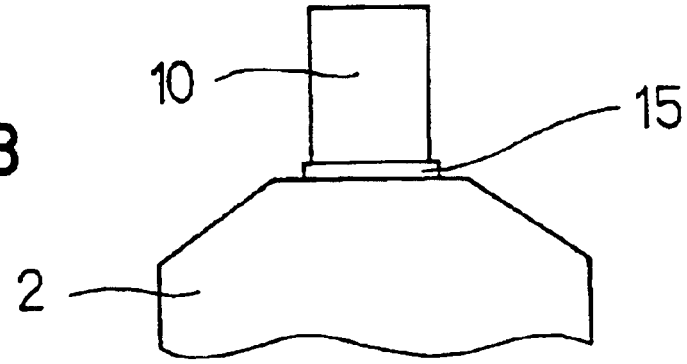
Figure 9C:
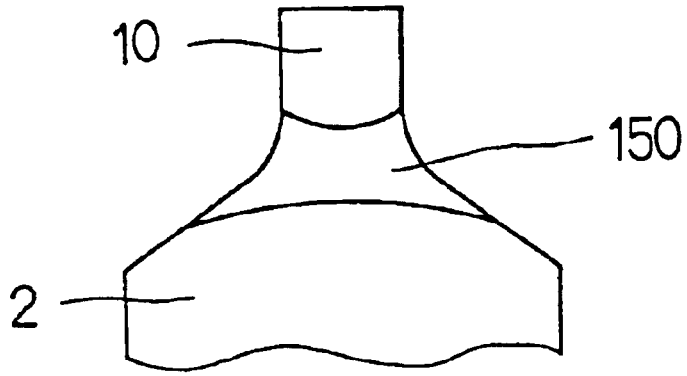
FIG. 9C is a fragmentary view showing a bonded center electrode as a second embodiment according to the present invention.

A second embodiment according to the present invention will be described, referring to FIGS. 9A, 9B, 9C and 10. In this embodiment, noble metal chip 10 made of Ir containing no Rh is used, and rhodium (Rh) chip 15 is placed between noble metal chip 10 and center electrode 2 so that Rh is melted into molten bond 150 by laser welding. As shown in FIG. 9A, Rh chip 15 is placed on end surface 211 of center electrode 2 and preliminarily connected to it by resistance welding. Then, as shown in FIG. 9B, noble metal chip 10 is placed on Rh chip 15 and preliminarily connected to it by resistance welding. The laser beam having energy of 7.5 J is radiated and focused on the periphery of Rh chip 15 to form molten bond 150 in the same manner as in the first embodiment. Noble metal chip 10 and center electrode 2 are welded together with molten bond 150 interposed therebetween as shown in FIG. 9C. Molten bond 150 is an alloy containing Rh, Ir (material of noble metal chip 10) and Ni (material of center electrode 2). Some samples were made, in which the thickness of Rh chip 15 is varied so that content of Rh in the molten bond is also varied. These samples are subjected to the durability test under the same conditions as in the first embodiment.

Figure 10:
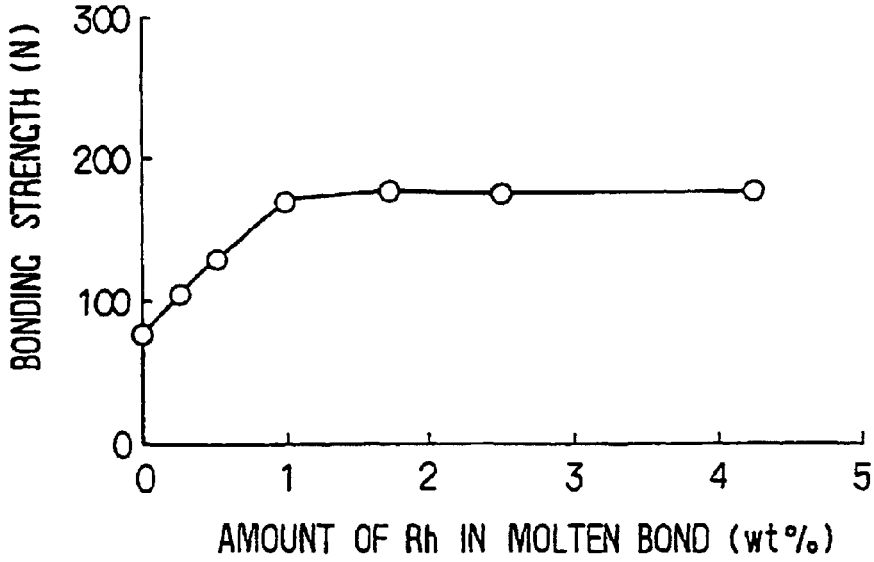
FIG. 10 is a graph showing the relation between the amount of Rh contained in a molten bond and bonding strength.

The durability test results are shown in FIG. 10 in which the amount of Rh contained in the molten bond is shown on the abscissa and the bonding strength is shown on the ordinate. It is seen in the graph that a sufficient bonding strength is obtained when more than 1 wt % of Rh is contained in the molten bond. In place of Rh chip 15, a platinum (Pt) chip and a palladium (Pd) were also tested, and the results were the same as those of the Rh chip. In this particular embodiment, Rh chip 15 having a diameter of 0.7 mm is used. However, other sizes of Rh chip 15, for example, those having diameter of 0.4 to 1.5 mm may also be used.

Figure 11:
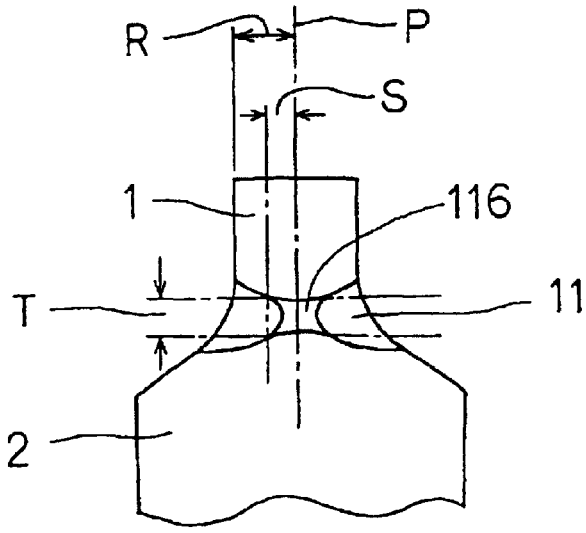
FIG. 11 is a fragmentary view showing a center electrode as a third embodiment having a molten bond which includes an unmolten portion.
Figure 12:
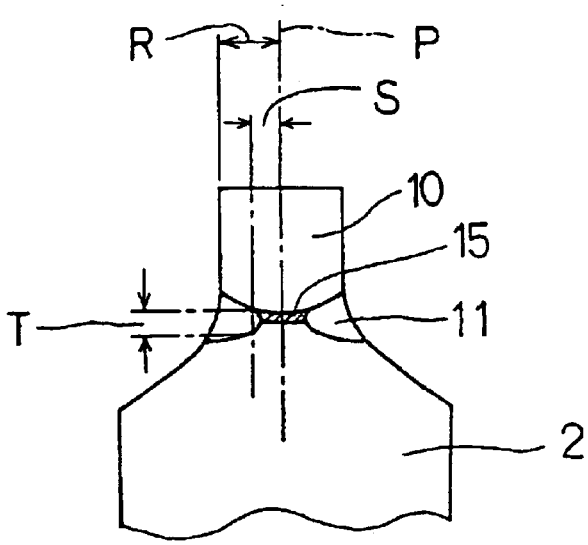
FIG. 12 is a fragmentary view showing a center electrode as a variation of the third embodiment.

A third embodiment according to the present invention is shown in FIGS. 11 and 12, in which molten bond 11 includes unmolten portion 116 at its center. In this embodiment, the junction of noble metal chip 1 and center electrode 2 are welded together by the laser beam only at its periphery, leaving unmolten portion 116 at its center as shown in FIG. 11. If the thickness T in which more than 1 wt % of Rh is contained in molten bond 11 is thicker than 0.2 mm, noble metal chip 1 and center electrode 2 are securely bonded, the thermal stress in the molten bond being sufficiently small. The thickness T is measured at a position apart from center line P by distance S which is a half of radius R of noble metal chip 1, as shown in FIG. 11. In an example shown in FIG. 12, Rh chip 15 is disposed between noble metal chip 10 and center electrode 2 as in the second embodiment, and a part of Rh chip 15 is left unmelted while its peripheral part is melted to form molten bond 11. In this case too, if the thickness T is thicker than 0.2 mm, the bonding strength is sufficiently high. In the first and second embodiments in which the molten bond is made without leaving the unmolten part therein, it is also preferable to make the thickness T thicker than 0.2 mm.

Figure 13:
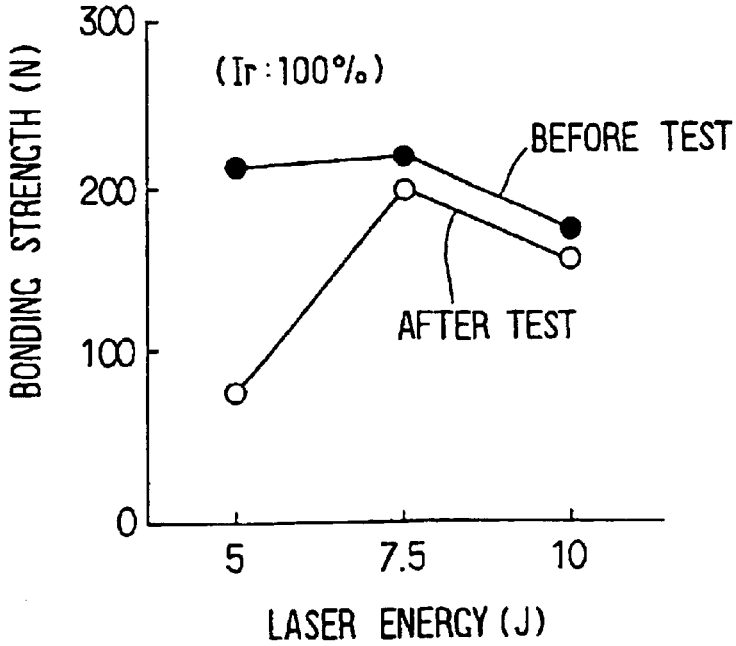
FIG. 13 is a graph showing the relation between laser energy and bonding strength of a molten bond of a center electrode as a comparative example.
Figure 14:
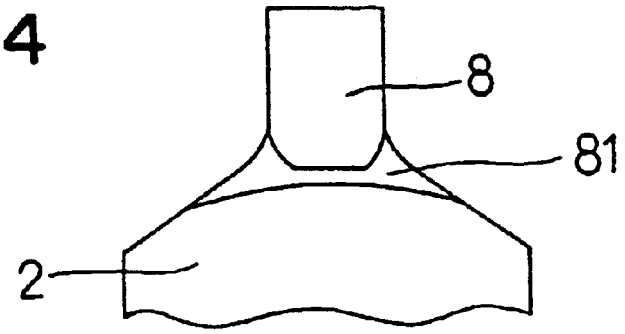
FIGS. 14 to 16 are fragmentary views showing a molten bond in the comparative example.
Figure 15:
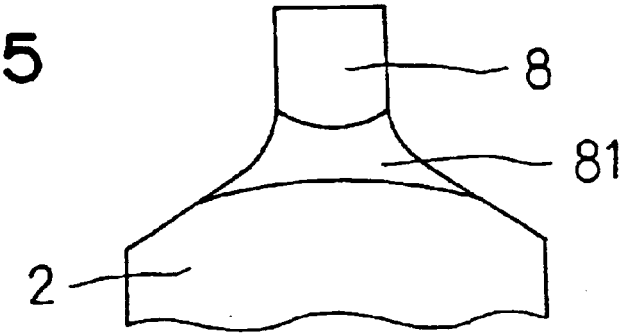
Figure 16:
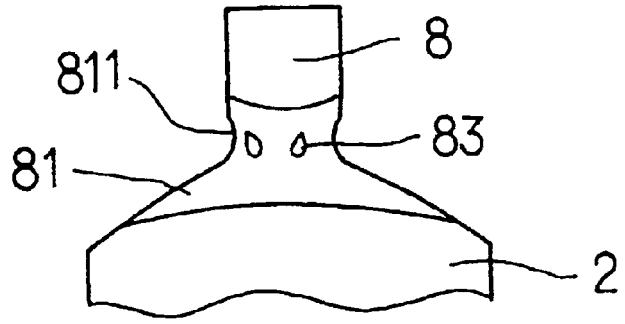

For a comparison purpose, samples in which noble metal chip 8 made of Ir containing no Rh therein is directly welded to center electrode 2 are made. The laser welding is carried out with laser energy of 5.0 J, 7.5 J and 10.0 J, respectively. Then, the comparative samples are subjected to the same durability test, the results of which are shown in FIG. 13. As seen in the graph, the bonding strength of a sample in which its molten bond is formed with 5 joule laser energy is much reduced after the durability test, while other samples welded with higher energy show a less change before and after the test (compare with the test results shown in FIG. 4). This means that the bonding strength of the comparative samples heavily depends on the laser beam energy. This is because the molten bond of the comparative samples does not contain Rh melted therein. FIGS. 14 to 16 show the shape of the molten bonds which are made with laser energy 5.0 J, 7.5 J and 10.0 J, respectively. In the case of laser energy 5.0 J (FIG. 14), molten bond 81 is small, and noble metal chip 8 is not melted much into the molten bond (compare with FIG. 6). In the case of laser energy 7.5 J (FIG. 15), molten bond 81 is a little smaller than that shown in FIG. 7. In the case of laser energy 10.0 J (FIG. 16), molten bond 81 has large depression 811 at its periphery and includes voids 83 therein (compare with FIG. 8).

For a further comparison purpose, other comparative samples are made in which the noble metal chip made of Ir containing 5 wt % of iron (Fe), vanadium (V), boron (B) or titanium (Ti) is used. The reason these metals are selected is that their linear expansion coefficient lies between those of nickel (Ni) and iridium (Ir). The comparative samples are subjected to the same durability test. The bonding strength of each sample is lower by 5 to 20% than that of the embodiments of the present invention which include Rh in the molten bond. On observation of the shape of the molten bond after the durability test, small cracks are found in the molten bond. The reason for this may reside in that the metals, Fe, V, B and Ti are oxidized easier than Rh, and accordingly some oxides are formed in the molten bond during the durability test. Also, these metals are not melted into the molten bond with their entire volume and form metal compounds, such as $Ir_3Ti$, which have a discontinuous linear expansion coefficient, and accordingly the thermal stress in the molten bond may not be sufficiently released.

In the foregoing embodiments of the present invention, an Ir alloy having a melting point higher than 2,200° C. is used as a noble metal chip to be connected to the tip of the center electrode. If the melting point is lower than that, the spark gap is excessively widened while the spark plug is used, and the widened spark gap requires a higher sparking voltage. It is preferable to use such an Ir alloy that has a melting point lower than 2,600° C. to have a 100° C. margin below the boiling point 2,700° C. of nickel (Ni) which is the material of the center electrode. The Ir alloy may be any one of the alloys which contain at least either one of the following metals: platinum (Pt), palladium (Pd), rhodium (Rh), gold (Au), nickel (Ni) and ruthenium (Ru). Also, the Ir alloy may contain yttria ($Y_2O_3$) or zirconia ($ZrO_2$).

The molten bond is formed as an alloy containing materials of the noble metal chip such as Ir, the center electrode such as Ni and other noble metals such as Rh added to the noble metal chip or placed on the center electrode. More than 1 wt % of the added or placed noble metal having a melting point of 1,500 to 2,100° C. and a linear expansion coefficient of 8 to $11\times10^{-6}$/° C. is contained in the molten bond. If the melting point is lower than 1,500° C., a large depression is formed around the molten bond when the laser energy is high, because the melting point becomes close to that of Ni which is 1450° C. On the other hand, if the melting point is higher than 2,100° C., only Ni is melted without melting the noble metal when the laser energy is low, because both melting points of Ni and the noble metal are too much apart, which results in that the thermal stress is not released in the molten bond. The lower limit of the linear expansion coefficient of the added noble metal ($8\times10^{-6}$/° C.) is close to that of the noble metal chip, and the upper limit ($11\times10^{-6}$/° C.) is close to that of the center electrode. If the linear expansion coefficient of the added noble metal is below the lower limit or above the higher limit, the thermal stress cannot be released sufficiently in the molten bond. The amount of the noble metal contained in the molten bond is preferably in a range from 1 wt % to 10 wt %. If it is lower than 1 wt %, the bonding strength is decreased through a long time operation in a heat cycle at high and low temperatures. A higher content of the noble metal exceeding 10 wt % makes the spark plug too expensive.

In the process of the laser welding, the center electrode material such as Ni and the added noble metal such as Rh form an alloy such as Ni—Rh, and then this alloy and the noble metal chip such as Ir form a final alloy such as Ni—Rh—Ir constituting the molten bond. Because of the presence of Rh between Ir and Ni, it becomes easier for Ir to be melted into the molten bond even when the laser energy is low. This is because the melting point of Ir—Rh is lower than that of Ir, and Ir is melted into the molten bond in a form of Ir—Rh. Rh has such a characteristic that it melts into Ir with its entire volume. On the other hand, when the laser energy is high, evaporation of Ni is suppressed by the presence of Rh. This is because the melting point of Ni—Rh is higher than that of Ni. Therefore, formation of the depression around the molten bond and formation of voids in the molten bond are suppressed. As a result, the noble metal chip and the center electrode can be firmly bonded by the laser welding without much depending on the laser energy. Also, the thermal stress at the junction is greatly relieved by the molten bond. Accordingly, a higher durability of the spark plug is realized according to the present invention.

It is preferable to use metals such as Pt, Pd or Rh as the added or placed noble metal. It is also preferable to use a Ni alloy containing Fe and Cr as the center electrode material to avoid oxidization of the center electrode surface. Preferably, the thickness T of the molten bond in which more than 1 wt % of the added or placed noble metal is contained is made thicker than 0.2 mm. This assures that the bondage is made perfect and the thermal stress in the molten bond is made sufficiently low.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A method of manufacturing a spark plug for an internal combustion engine, the spark plug including an insulator having a through-hole formed therein, a center electrode made of a nickel-based alloy disposed at one end of the through-hole, a metal housing holding the insulator therein, and a ground electrode connected to the metal housing and disposed to face the center electrode, forming a spark gap therebetween, the manufacturing method comprising steps of:

attaching a noble metal chip directly on a flat end surface of the center electrode, the noble metal chip being made of an iridium alloy containing iridium and a noble metal having a melting point in a range from 1,500 to 2,100° C. and a linear expansion coefficient in a range from $8\times10^{-6}$ to $11\times10^{-6}$/° C., the iridium alloy having a melting point equal to or higher than 2,200° C., a surface area of the flat end surface of the center electrode, to which the noble metal chip is directly attached, being larger than a surface area of the noble area chip which is directly attached to the flat end surface of the center electrode; and radiating a laser beam on the noble metal chip in a direction substantially perpendicular to an axial direction of the center electrode, thereby forming a molten bond containing more than 1-weight-percent noble metal having a melting point in a range from 1,500 to 2,100° C. and a linear expansion coefficient in a range from $8\times10^{-6}$ to $11\times10^{-6}$/° C. between the center electrode and the noble metal chip, wherein the laser is a Yag laser, and wherein the Yag laser energy is in a range of 5.0 J–10.0 J.

2. The manufacturing method as in claim 1, wherein:

the noble metal contained in the molten bond is at least one selected from a group consisting of platinum, palladium and rhodium.

3. The manufacturing method as in claim 1, wherein:

the noble metal chip has a cylinder shape.

4. The manufacturing method as in claim 1, wherein:

a thickness of the molten bond in which more than 1-weight-percent noble metal is contained, measured at a position half a radius of the noble metal chip from a center thereof, is greater than 0.2 mm.

5. The manufacturing method as in claim 3, wherein:

the noble metal chip has a diameter in a range from 0.4 to 1.5 mm.

6. The manufacturing method as in claim 1, wherein the iridium alloy has a melting point lower than 2,600° C.

7. The manufacturing method as in claim 1, wherein the amount of the noble metal other than iridium contained in the molten bond is in a range from 1 wt % to 10 wt %.

8. The manufacturing method as in claim 1, wherein the nickel based alloy is a nickel alloy containing iron and chrome.

9. The manufacturing method as in claim 1, wherein the noble metal chip and center electrode are welded together by the laser beam substantially solely at a periphery thereof whereby an unmolten portion remains at a center thereof.

10. A method of manufacturing a spark plug for an internal combustion engine, the spark plug including an insulator having a through-hole formed therein, a center electrode made of a nickel-based alloy disposed at one end of the through-hole, a metal housing holding the insulator therein, and a ground electrode connected to the metal housing and disposed to face the center electrode, forming a spark gap therebetween, the manufacturing method comprising steps of:

disposing a first noble metal chip containing a noble metal having a melting point in a range from 1500 to 2100° C. and a linear expansion coefficient in a range from $8\times10^{-6}$ to $11\times10^{-6}$/° C. on an end surface of the center electrode;

disposing a second noble metal chip containing iridium on said first noble metal chip; and radiating a laser beam on the noble metal chips in a direction substantially perpendicular to an axial direction of the center electrode, thereby forming a molten bond containing more than 1-weight-percent of said noble metal having a melting point in a range from 1,500 to 2,100° C. and a linear expansion coefficient in a range from $8\times10^{-6}$ to $11\times10^{-6}$/° C. between the center electrode and the second noble metal chip.

11. The manufacturing method as in claim 10, wherein:

the noble metal contained in the molten bond is at least one selected from a group consisting of platinum, palladium and rhodium.

12. The manufacturing method as in claim 10, wherein:

the second noble metal chip has a cylinder shape.

13. The manufacturing method as in claim 10, wherein:

a thickness of the molten bond in which more than 1-weight-percent noble metal is contained, measured at a position half a radius of the second noble metal chip from a center thereof, is greater than 0.2 mm.

14. The manufacturing method as in claim 12, wherein:

the second noble metal chip has a diameter in a range from 0.4 to 1.5 mm.

15. The manufacturing method as in claim 10, wherein the nickel based alloy is a nickel alloy containing iron and chrome.

16. The manufacturing method as in claim 10, wherein the laser is a Yag laser.

17. The manufacturing method as in claim 16, wherein the Yag laser energy is in a range of 5.0 J–10.0 J.

18. The manufacturing method as in claim 10, wherein the metal chips and center electrode are welded together by the laser beam substantially solely at a periphery thereof whereby an unmolten portion remains at a center thereof.

* * * * *